US009414628B2

(12) United States Patent
Liu

(10) Patent No.: US 9,414,628 B2
(45) Date of Patent: Aug. 16, 2016

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 430 days.

(21) Appl. No.: 14/055,216

(22) Filed: Oct. 16, 2013

(65) Prior Publication Data

US 2015/0059782 A1 Mar. 5, 2015

(30) Foreign Application Priority Data

Aug. 27, 2013 (CN) ..... 2013 2 0526463

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 4,945,929 A * 8/1990 Egilmex ..... A24F 47/002 128/200.21
5,970,211 A * 10/1999 Ritsher ..... F24F 6/12 392/337
2008/0092912 A1* 4/2008 Robinson ..... A24F 47/008 131/200
2011/0304282 A1* 12/2011 Li ..... A24F 47/008 315/362
2012/0190252 A1* 7/2012 Pavlinsky ..... H01M 10/425 439/775
2012/0318882 A1* 12/2012 Abehasera ..... A61M 11/041 239/1
2013/0169230 A1* 7/2013 Li ..... A24F 47/008 320/114
2014/0230835 A1* 8/2014 Saliman ..... A24F 47/008 131/329

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

An electronic cigarette is provided, which comprises a battery component. A battery, a PCB board and a press-key switch are provided in the battery component, and the press-key switch is set on the PCB board. An end face of the battery is located opposite one end face of the PCB board. A first electrode pin and a second electrode pin are provided on one end face of the battery, wherein the end face of the battery is adjacent to the PCB board. A first socket and a second socket are provided at one side of the PCB board, wherein the side of the PCB board is adjacent to the battery. The first electrode pin is inserted and soldered in the first socket, and the second electrode pin is inserted and soldered in the second socket.

4 Claims, 5 Drawing Sheets

ELECTRONIC CIGARETTE

CROSS-REFERENCE TO RELATED APPLICATIONS

This non-provisional application claims priorities under 35 U.S.C. §119(a) on Patent Application No. 201302526463.2 filed in P.R. China on Aug. 27, 2013, the entire contents of which are hereby incorporated by reference.

FIELD OF THE APPLICATION

The present application relates to the field of electrically heating technology, and more particularly, relates to an electronic cigarette.

BACKGROUND OF THE APPLICATION

The electronic cigarette has been used more and more widely as a replacement for the cigarette. The electronic cigarette mainly comprises an atomizer component and a battery component. The battery component comprises a case. A battery, a gas flow sensor and a control circuit, etc. are provided in the case. Although there are various kinds of electronic cigarettes in the market, for most of them, the inner structures are irrational and the assembly for them is inconvenient, because most of them only focus on the beautiful appearances. For example, in a traditional electronic cigarette, both ends of the battery are connected to and soldered with the control circuit via normal soft conductive wires, and the battery must be located in the battery sleeve before both ends of the battery is connected to and soldered with the control circuit. Thus, the assembling process for the electronic cigarette is complex, and the connection between the battery and the control circuit in the battery sleeve is not reliable, which will affect the performance of the electronic cigarette.

SUMMARY OF THE APPLICATION

The object of the present application is to provide an electronic cigarette with simple assembling process, aiming at the drawbacks that the assembling process for the traditional electronic cigarette is multifarious and complicated in the prior art.

The technical schemes to solve the above technical problems are as follows.

In one aspect, an electronic cigarette is provided, which comprises a battery component. A battery, a PCB board and a press-key switch are provided in the battery component, and the press-key switch is set on the PCB board. An end face of the battery is located opposite one end face of the PCB board. A first electrode pin and a second electrode pin are provided on one end face of the battery, wherein the end face of the battery is adjacent to the PCB board. A first socket and a second socket are provided at one side of the PCB board, wherein the side of the PCB board is adjacent to the battery. The first electrode pin is inserted and soldered in the first socket, and the second electrode pin is inserted and soldered in the second socket.

In one embodiment, the electronic cigarette further comprises a fix base for fixing the PCB board. A mount slot is provided on the fix base. The PCB board is fixed in the mount slot, and the end face of the battery is located opposite one end face of the fix base.

In this embodiment, the electronic cigarette further comprises an atomizer component. The PCB board is electrically connected to the atomizer component via the press-key switch. The press-key switch is configured to control the operation of the atomizer component.

In this embodiment, the battery component further comprises an outer sleeve and a first outer electrode. The outer sleeve sheaths around the first outer electrode. The first outer electrode is used to electrically connect the atomizer component. The PCB board is located between the first outer electrode and the battery.

In this embodiment, a buckling slot is provided at one side of the fix base and the side of the fix base is far away from the battery. One end of the first outer electrode is snapped into the buckling slot.

In this embodiment, the press-key switch comprises a switch base fixed on the PCB board and a button set on the switch base. A first through hole is defined on a side wall of the outer sleeve, wherein the side wall is corresponding to the press-key switch. The button is embedded in the first through hole and extends out from the outer sleeve. The press-key switch is installed on one end face of the battery component.

In another embodiment, the battery component further comprises an outer sleeve and an end cap that covers on one end face of the outer sleeve. The press-key switch is inserted in the end cap. The end cap comprises a body portion and a cap portion. The outer sleeve sheaths around the body portion, and the cap portion covers on the outer sleeve. The end face of the body portion, which is far away from the cap portion, extends axially to form two fix slices. The PCB board is fixed between the two fix slices. The press-key switch comprises a switch base fixed on the PCB board and a button set on the switch base. A second through hole is provided on the cap portion, and the button is embedded in the second through hole and extends out from the cap portion.

In this embodiment, the outer sleeve is made of metallic conductive material. An electrode piece is provided on the PCB board, and the electrode piece abuts the outer sleeve. The battery component further comprises a first outer electrode that is set on the end far away from the end cap. The first outer electrode is sheathed around by the outer sleeve and adapted to the outer sleeve.

The following beneficial effects will be achieved when implementing the electronic cigarette of the present application. In the electronic cigarette, a first electrode pin and a second electrode pin are provided on a same end face of the battery, and a corresponding first socket and a corresponding second socket are provided on the PCB board that is fixed with a press-key switch. Through inserting and soldering the first electrode pin in the first socket, and inserting and soldering the second electrode pin in the second socket, the battery can be fixed on the PCB board. Thus the battery and the press-key switch can be fixed on a same PCB board. In the assembling process, the PCB board, the first outer electrode and the battery are fixedly integrated first, and then the whole of them is inserted into the outer sleeve from one end of the outer sleeve. In this way, the assembling process is convenient, simple, and able to be modularized, which can increase the productive efficiency. Besides, the inner structure is rational and the electrical connections are reliable, which has effectively avoided the short circuits caused by the wires in a mess.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENTS

To make the objects, technical schemes and advantages more clearly, the present application may be further described in detail with reference to the accompanying drawings and embodiments.

Figure 1:
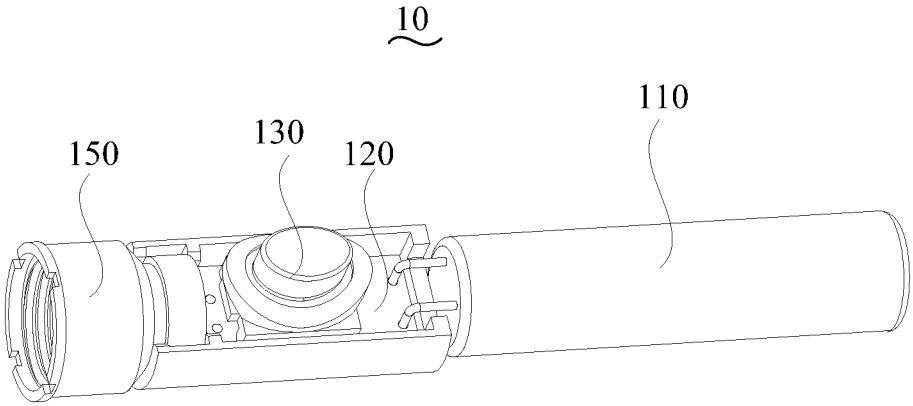
FIG. 1 is a structure diagram of a battery component in an electronic cigarette in a first embodiment of the present application.
Figure 2:
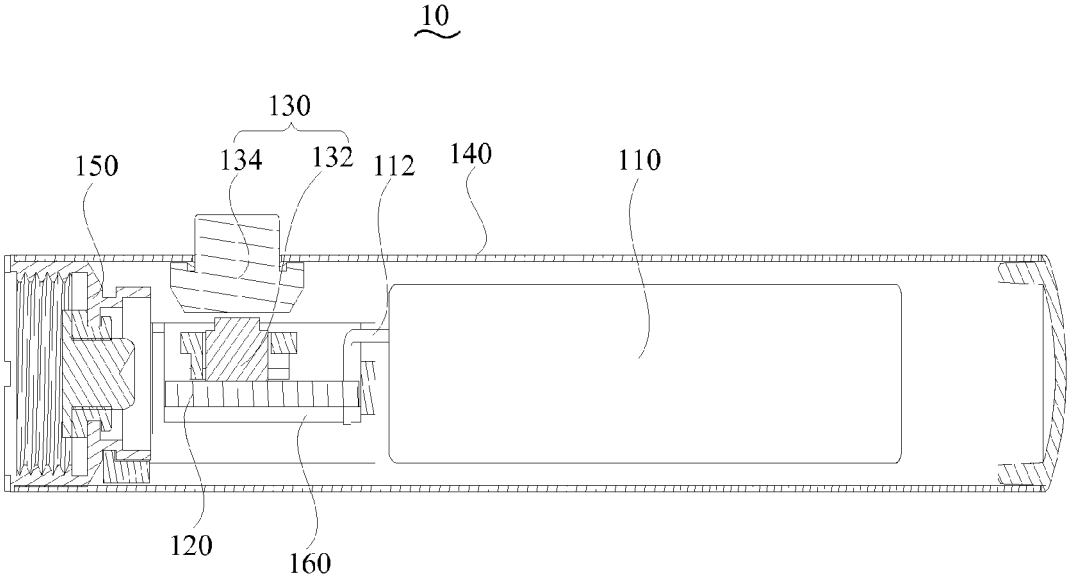
FIG. 2 is a sectional view of FIG. 1.

Referring to FIGS. 1 and 2, in the first embodiment of the present application, an electronic cigarette comprises a battery component 10 and an atomizer component (not shown). The battery component 10 and the atomizer component are connected to each other in a detachable way. Namely, the battery component 10 and the atomizer component are connected to from a whole electronic cigarette.

The battery component 10 comprises a battery 110, a PCB board 120, a press-key switch 130, an outer sleeve 140, a fix base 160, a first outer electrode 150 and an end cap 170. The battery 110, the PCB board 120, the fix base 160 and the first outer electrode 150 are all sheathed around by the outer sleeve 140. The end cap 170 covers on one end face of the outer sleeve 140. The first outer electrode 150 is sheathed around by the outer sleeve 140 which is far away from the end cap 170. The first outer electrode 150 is connected to an electrode in the atomizer component, in order to power a heating wire in the atomizer component to atomize the tobacco oil.

Figure 3:
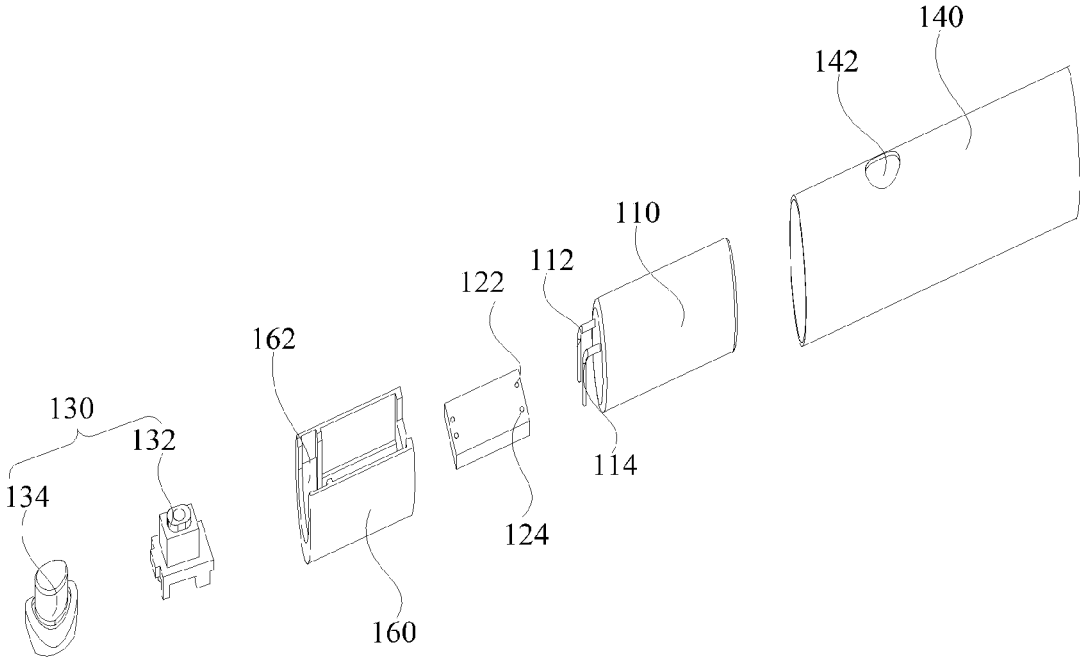
FIG. 3 is a partially explosive view of the battery component shown in FIG. 1.

Referring to FIG. 3, the fix base 160 is substantially ship-shaped, which is mounted between the first outer electrode 150 and the battery 110. An end face of the battery 110 is located opposite one end face of the fix base 160. A mount slot (not labeled) is provided on the fix base 160. The PCB board 120 is mounted in the mount slot, so that the PCB board 120 is fixed in the fix base 160. A buckling slot 162 is provided at one side of the fix base 160 and the side of the fix base 160 is far away from the battery 110. The shape and the size of the buckling slot 162 are matched with the end portion of the first outer electrode 150, so one end of the first outer electrode 150 can be snapped into the buckling slot 162, and in this way, the first outer electrode 150 can be fixedly connected to the fix base 160. It should be understood that the fix base 160 is made of insulating material which does not have conductive ability.

In the embodiment, the PCB board 120 is mounted in the mount slot and located between the first outer electrode 150 and the battery 110. The PCB board 120 is substantially a rectangular plate. One end face of the PCB board 120 is located corresponding to one end face of the battery 110, wherein the end face of the battery 110 is adjacent to the PCB board 120. A first socket 122 and a second socket 124 are provided at one side of the PCB board 120, wherein the side of the PCB board 120 is adjacent to the battery 110. The first socket 122 and the second socket 124 are configured to accept two electrodes of the battery 110. An interval is defined between the first socket 122 the second socket 124. The first socket 122 and the second socket 124 are both electrical sockets.

The press-key switch 130 is installed on the PCB board 120. The PCB board 120 is electrically connected to the atomizer component via the press-key switch 130. The press-key switch 130 is configured to control the operation of the atomizer component. Namely, the operation of the atomizer component can be controlled through the on and off of the press-key switch 130. When the press-key switch 130 is closed, the atomizer component will operate and atomize the tobacco oil. When the press-key switch 130 is turned off, the atomizer component will stop working. The press-key switch 130 comprises a switch base 132 fixed on the middle of the PCB board and a button 134 set on the switch base 132. A first through hole 142 is defined on a side wall of the outer sleeve 140, wherein the side wall is corresponding to the press-key switch 130. The size of the first through hole 142 is matched with the button 134, so that the button 134 can be embedded in the first through hole 142 and extends out from the outer sleeve 140, which may make it convenient for user to operate on the button 134. A first electrode pin 112 and a second electrode pin 114 are provided on one end face of the battery 110, wherein the end face of the battery 110 is adjacent to the PCB board 120. Namely, the first electrode pin 112 and the second electrode pin 114 are set on a same end face of the battery 110, and each of the first electrode pin 112 and the second electrode pin 114 is the positive pole or negative pole of the battery 110.

In the embodiment, the battery 110 is a pin-typed battery which has two pins 112 and 114, for example, a capacitive pin-typed battery. The first electrode pin 112 is corresponding to the first socket 122 on the PCB board 120, and the second electrode pin 114 is corresponding to the second socket 124. Thus, the first electrode pin 112 can be inserted in the first socket 122, and the second electrode pin 114 can be inserted in the second socket 124. Then, the first electrode pin 112 and the second electrode pin 114 are soldered respectively, in order to fix them solidly on the PCB board 120. Therefore, a battery component 10, in which the press-key button 130 and the battery 110 are soldered on a same PCB board 120, can be made. The assembling process for the battery component 10 is convenient, simple and able to be modularized, so that the productive efficiency can be improved. Furthermore, in the embodiment, the PCB board 120, the first outer electrode 150 and the battery 110 are fixedly integrated first, and then the whole of them is inserted into the outer sleeve 140 from one end of the outer sleeve 140. In this way, the assembling process is convenient, the inner structure is rational and the electrical connections are reliable, which has effectively avoided the short circuits caused by the wires in a mess.

Figure 4:
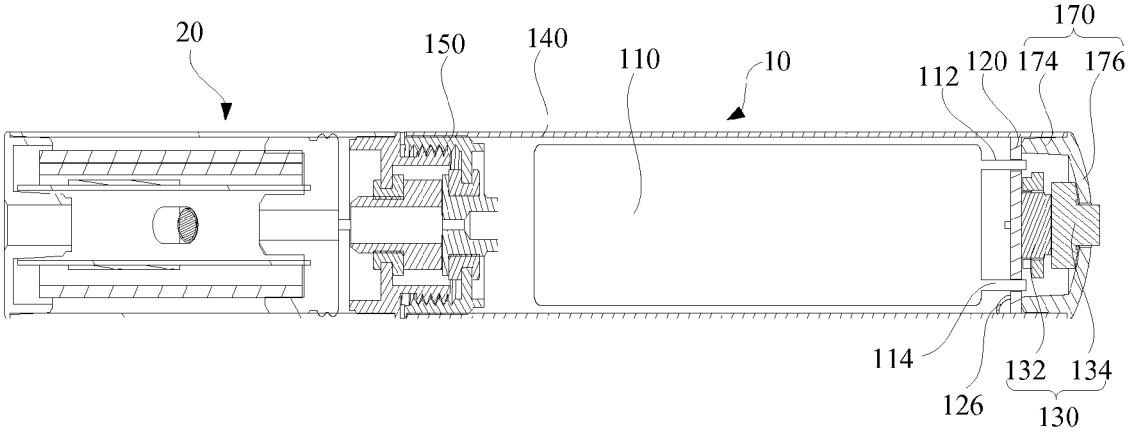
FIG. 4 is a sectional view of an electronic cigarette in a second embodiment of the present application.
Figure 5:
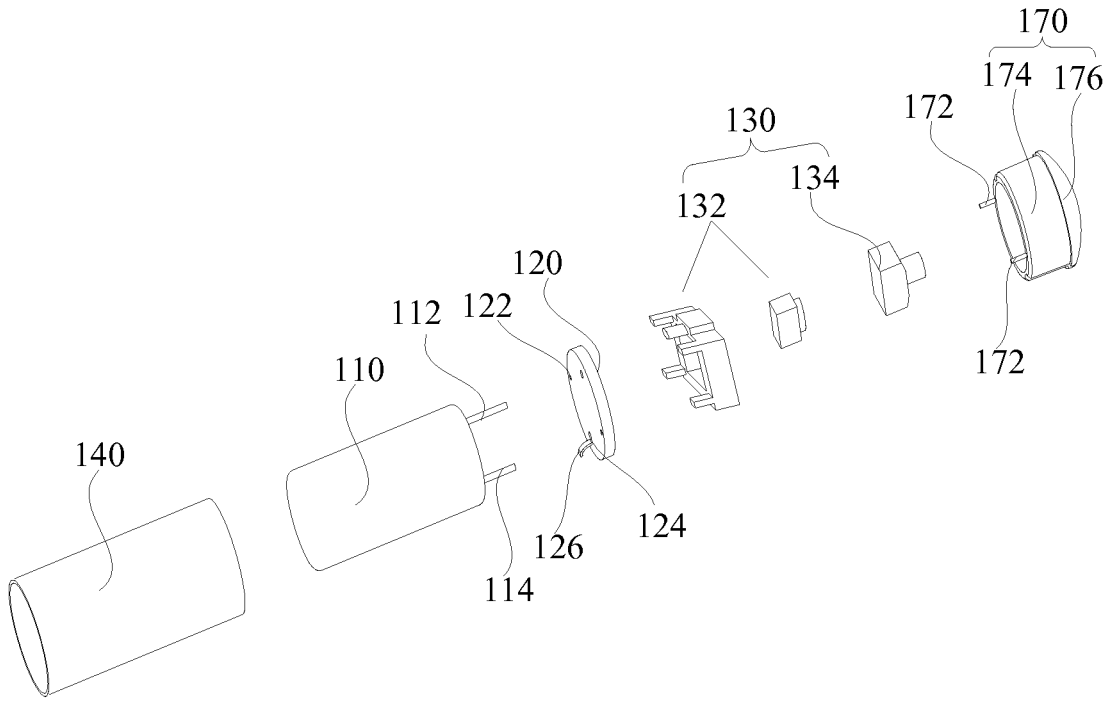
FIG. 5 is an explosive view of the battery component shown in FIG. 4.

Referring to FIGS. 4 and 5, a second embodiment of an electronic cigarette is provided. Compared with the first embodiment, in the second embodiment, the location of the PCB board 120 is different, and there is not a fix base 160 for fixing the PCB board 120.

In the embodiment, the press-key switch 130 is installed on one end face of the battery component 10.

The battery component 10 comprises an end cap 170 that covers on one end face of the outer sleeve 140, wherein the end face of the outer sleeve 140 is far away from the first outer electrode 150. The end cap 170 comprises a body portion 174 and a cap portion 176. The outer sleeve 140 sheaths around the body portion 174. The cap portion 176 covers on the end face of the outer sleeve 140. The press-key switch 130 is inserted in the cap portion 176. The end face of the body portion 174, which is far away from the cap portion 176, extends axially to form two fix slices 172. The two fix slices 172 are located symmetrically with respect to the central axis of the body portion 174. The PCB board 120 is buckled between the two fix slices 172, in which way the PCB board 120 can be fixed in the outer sleeve 140. A second through hole (not labeled) is provided on the cap portion 176. In the embodiment, a switch base 132 of the press-key switch 130 is fixed on the PCB board 120, and a button 134 is embedded in the second through hole and extends out from the cap portion 176, in order to make the operation to the button 134 more convenient and meet different demands for the location of the switch. The end cap 170 may be a lamp crown component. When the atomizer component 20 is in a working state, the end cap 170 leads out the light to indicate that the atomizer component 20 stays in a working state. In other embodiments, the end cap 170 may be a sealing cap which can seal the battery component 10.

In the embodiment, the outer sleeve 140 is made of metallic conductive material which has conductive ability. An electrode piece 126 is provided on the PCB board 120, and the electrode piece 126 abuts the inner side wall of the outer sleeve 140. A first outer electrode 150 is set on the end far away from the end cap 170, and the first outer electrode 150 is sheathed around by the outer sleeve 140 and adapted to the outer sleeve 140. Thus, electric charges can flow in the battery component 10. When the press-key switch 130 is closed, namely the electronic cigarette is in a working state, the charge flow in the battery 10 can flow through the electrode slices 126, the outer sleeve 140 and the first outer electrode 150 successively, and then flow into the atomizer component 20 to atomize the tobacco oil through heating wires. In this way, the electronic cigarette can operate normally.

In the electronic cigarette of the present application, a first electrode pin 112 and a second electrode pin 114 are provided on a same end face of the battery 110, and a corresponding first socket 122 and a corresponding second socket 124 are provided on the PCB board 120 that is fixed with a press-key switch 130. Through inserting and soldering the first electrode pin 112 in the first socket 122, and inserting and soldering the second electrode pin 114 in the second socket 124, and locating the end face of the battery 110 opposite one end face of the PCB board 120, the battery 110 and the press-key switch 130 can be fixed on a same PCB board 120. The assembling process is convenient, simple, and able to be modularized, which can increase the productive efficiency. Furthermore, the PCB board 120, the first outer electrode 150 and the battery 110 are fixedly integrated first, and then the whole of them is inserted into the outer sleeve 140. In this way, the assembling process is convenient, the inner structure is rational, and the electrical connections are reliable, which has effectively avoided the short circuits caused by the wires in a mess.

While the embodiments of the present application have been described with reference to the drawings, the present application will not be limited to above embodiments that are illustrative but not limitative. It will be understood by those skilled in the art that various changes and equivalents may be substituted in the light of the present application without departing from the scope of the present application, and those various changes and equivalents shall fall into the protection of the application.

What is claimed is:

1. An electronic cigarette comprising a battery component, wherein a battery, a printed circuit board and a press-key switch being provided in the battery component, and the press-key switch is set on the printed circuit board, an end face of the battery is located opposite one end face of the printed circuit board; a first electrode pin and a second electrode pin are provided on one end face of the battery;

wherein the end face of the battery is adjacent to the printed circuit board; a first socket and a second socket are provided at one side of the printed circuit board, wherein the side of the printed circuit board is adjacent to the battery; the first electrode pin is inserted and soldered in the first socket, and the second electrode pin is inserted and soldered in the second socket;

wherein the press-key switch is installed on one end face of the battery component;

wherein the battery component further comprises an outer sleeve and an end cap that covers on one end face of the outer sleeve; the press-key switch is inserted in the end cap;

wherein the end cap comprises a body portion and a cap portion; the outer sleeve sheaths around the body portion; the cap portion covers on the outer sleeve; the end face of the body portion, which is opposite from the cap portion, extends axially to form two fix slices; the printed circuit board is fixed between the body portion;

wherein the outer sleeve is made of metallic conductive material; an electrode piece is provided on the printed circuit board; the electrode piece abuts the outer sleeve; the battery component further comprises a first outer electrode that is set on the end opposite from the end cap; the first outer electrode is sheathed around by the outer sleeve and adapted to the outer sleeve.

2. The electronic cigarette according to claim 1, wherein the electronic cigarette further comprises an atomizer component; the printed circuit board is electrically connected to the atomizer component via the press-key switch; the press-key switch is configured to control the operation of the atomizer component.

3. The electronic cigarette according to claim 2, wherein the battery component further comprises an outer sleeve and a first outer electrode; the outer sleeve sheaths around the first outer electrode; the first outer electrode is used to electrically connect the atomizer component.

4. The electronic cigarette according to claim 1, wherein the press-key switch comprises a switch base fixed on the printed circuit board and a button set on the switch base; a second through hole is provided on the cap portion; the button is embedded in the second through hole and extends out from the cap portion.

* * * * *